US005257034A

United States Patent [19]

Turner et al.

[11] Patent Number: 5,257,034

[45] Date of Patent: Oct. 26, 1993

[54] COLLAPSIBLE APPARATUS FOR FORMING A PARABOLOID SURFACE

[75] Inventors: Stephen Turner, Fremont; Perry Ciampaglia, Mountain View; Dan Montesanto, Palo Alto, all of Calif.

[73] Assignee: Space Systems/Loral, Inc., Palo Alto, Calif.

[21] Appl. No.: 921,911

[22] Filed: Jul. 29, 1992

[51] Int. Cl.[5] ..... H01Q 15/20

[52] U.S. Cl. ..... 343/915; 343/840; 343/DIG. 2; 359/853

[58] Field of Search ..... 343/912, 915, 916, 840, 343/DIG. 2; 359/853, 855; 126/690, 693

[56] References Cited

U.S. PATENT DOCUMENTS

| | | | |
|---|---|---|---|
| 3,715,760 | 2/1973 | Palmer | 343/915 |
| 4,511,901 | 4/1985 | Westphal | 343/915 |
| 4,646,102 | 2/1987 | Akaeda et al. | 343/915 |
| 4,780,726 | 10/1988 | Archer et al. | 343/915 |
| 4,811,034 | 3/1989 | Kaminskas | 343/915 |
| 4,862,190 | 8/1989 | Palmer | 343/915 |
| 4,899,167 | 2/1990 | Westphal | 343/916 |

*Primary Examiner*—Michael C. Wimer
*Assistant Examiner*—Tan Ho
*Attorney, Agent, or Firm*—Edward J. Radlo

[57] ABSTRACT

A compact, reliable, paraboloid shaped assembly 7 is used as a reflector 7 on a satellite. The apparatus 7 is assembled from multiple panels 2, 3, 4, which connect to a central base 1 using hinges 20, 21. The apparatus 7 is compacted by rotating some or all of the panels 2, 3, 4 to be adjacent to one side 12 of the central base in stages, such that alternate panels 3 are rotated first. Folded onto these panels 3 are the remaining backwards-folding panels 2. The panels 4 which are not rotated backwards are then rotated forwards, completing a highly compact design. For deployment, the panels 2, 3, 4 are rotated in the reverse order and direction in which they were compacted. Latches 10 connect adjacent panels 2, 3, 4 and hold the panels 2, 3, 4 in the deployed position.

18 Claims, 2 Drawing Sheets

COLLAPSIBLE APPARATUS FOR FORMING A PARABOLOID SURFACE

FIELD OF THE INVENTION

This invention relates to a paraboloid and, more specifically, to a collapsible paraboloid shaped apparatus, the surface of which is usable as an antenna reflector on a satellite.

DESCRIPTION OF BACKGROUND ART

Paraboloids are often used as antenna reflectors attached to satellites. The paraboloid is often used to collect and reflect electromagnetic energy into or out of a "feedhorn" which brings concentrated energy into or out of the satellite.

Two basic designs characterize such reflectors. In a "center fed" design, the feedhorn is mounted directly along the central axis of the reflector. Often, the feedhorn in this design interferes with the incoming or outgoing signals. An alternative design which eliminates this problem is an "offset" design, in which the parabolic reflector is shaped to reflect and concentrate the signal off of the center of the paraboloid, allowing the feedhorn to be placed to one side, out of the way of the signal.

Two basic materials, wire mesh and solid materials, are used in both designs. A wire mesh material is lightweight, but does not reflect as well. For some transmissions, a mesh is impractical. A solid material solves this problem, but can be somewhat heavier than the mesh.

There are competing interests at stake when a paraboloid reflector is sent into space. The larger the reflector, the better its transmission and reception capabilities. However, the diameter of the spacecraft used to launch the reflector can limit its size. It is therefore necessary to pack a paraboloid surface more compactly for transport in the launch vehicle.

While reducing the diameter of the reflector can make its launch feasible, it may not necessarily make the launch cost efficient. Because launch vehicles often hold more than one device, the more compactly the paraboloid is packed, the more devices may be launched in the same vehicle, dramatically reducing costs.

Competing with the goals of practicality and cost is reliability and ease of deployment. Once launched, a collapsed paraboloid must be deployed for use in space. Simpler deployment mechanisms are preferred for their improved reliability. Complex mechanisms are more prone to failure and are thus much less desirable.

In addition, it is highly desirable to employ a mechanism that is simple enough for automatic operation. Not only does such a device allow for deployment from both manned and unmanned launch vehicles, but it also avoids the difficulties and expense of an astronaut, in full space suit, required to deploy alternative designs.

The background art contains several attempts to pack a paraboloid surface more compactly. While such attempts succeed in reducing the diameter of the paraboloid, the reduced paraboloid structures still occupy large volumes in the launch vehicle, resulting in high costs for each device launched. In addition, the deployment mechanisms of the background art are complex, and thus prone to failure. Where these problems are solved, the deployment requires the services of an astronaut outside the launch vehicle.

Recent attempts to pack a paraboloid accomplish a reduction in diameter. However, the resulting structure nevertheless occupies a large volume in the launch vehicle, and the resulting deployment structure is complex and unreliable. (Palmer, U.S. Pat. No. 4,862,190, issued Aug. 29, 1989). In the Palmer device, the paraboloid is compacted by folding outer panels in an accordion-like fashion in front of a central panel, resulting in a device which, although smaller in diameter, occupies a great deal of space in the launch vehicle. In addition, its many panels remain connected even when compacted through the use of a large number of hinges, each of which lowers the reliability of the system as a whole. Further, it requires a motor for automatic deployment, greatly reducing its reliability. Because of the complexity of the Palmer design, more reliable deployment methods, such as pyrotechnics, cannot be used.

Another attempt (Westphal, U.S. Pat. No. 4,511,901) also collapses into a shape with a smaller radius, but having a large volume. Further, Westphal uses an extremely complex hinge structure which allows both pivoting and rotation simultaneously. The hinge structure as well as the connecting structure makes the Westphal design unreliable as well. Still another attempt reduces the complexity of the design and deployment mechanisms, but fails to achieve a truly compact design. (U.S. patent application Ser. No. 07/751,719, filed Aug. 29, 1991, having the same assignee as the present invention.)

An attempt which succeeds in reducing the volume occupied by the collapsed apparatus nevertheless requires a complex assembly procedure, necessitating the services of an astronaut, and precluding the use of an unmanned rocket as a launch vehicle. (Kaminskas, U.S. Pat. No. 4,811,034). Kaminskas provides a compact structure, but never succeeds in providing a mechanism that is simple enough to deploy automatically.

None of these background art devices simultaneously reduces the diameter of the paraboloid while keeping volume requirements low by the use of a simple, reliable design that is easy to deploy automatically.

DISCLOSURE OF INVENTION

The invention resides in the use of a design which collapses by folding outer portions 2 and 3 of the paraboloid "backwards," toward its second side 12. This design resolves problems in the background art by providing a collapsible paraboloid structure 7 that is compact, as well as reliable to deploy, and allows for automatic deployment without the use of motors or other complex mechanisms.

The apparatus 7 is assembled from panels 2, 3, and 4, some of which fold backwards behind a central base 1 using simple hinges, while other panels 4 fold forwards. This allows for an extremely space-efficient, compacted structure. Because the invention maintains simplicity in the deployment structure, the apparatus 7 provides high reliability, while the deployment mechanism enables simple, automated methods of deployment, such as pyrotechnics, well known in the space industry.

The invention may be used with both center-fed as well as offset-fed designs. In addition, both wire mesh as well as solid materials may be used.

DETAILED DESCRIPTION OF THE PREFERRED EMBODIMENTS

Figure 1:
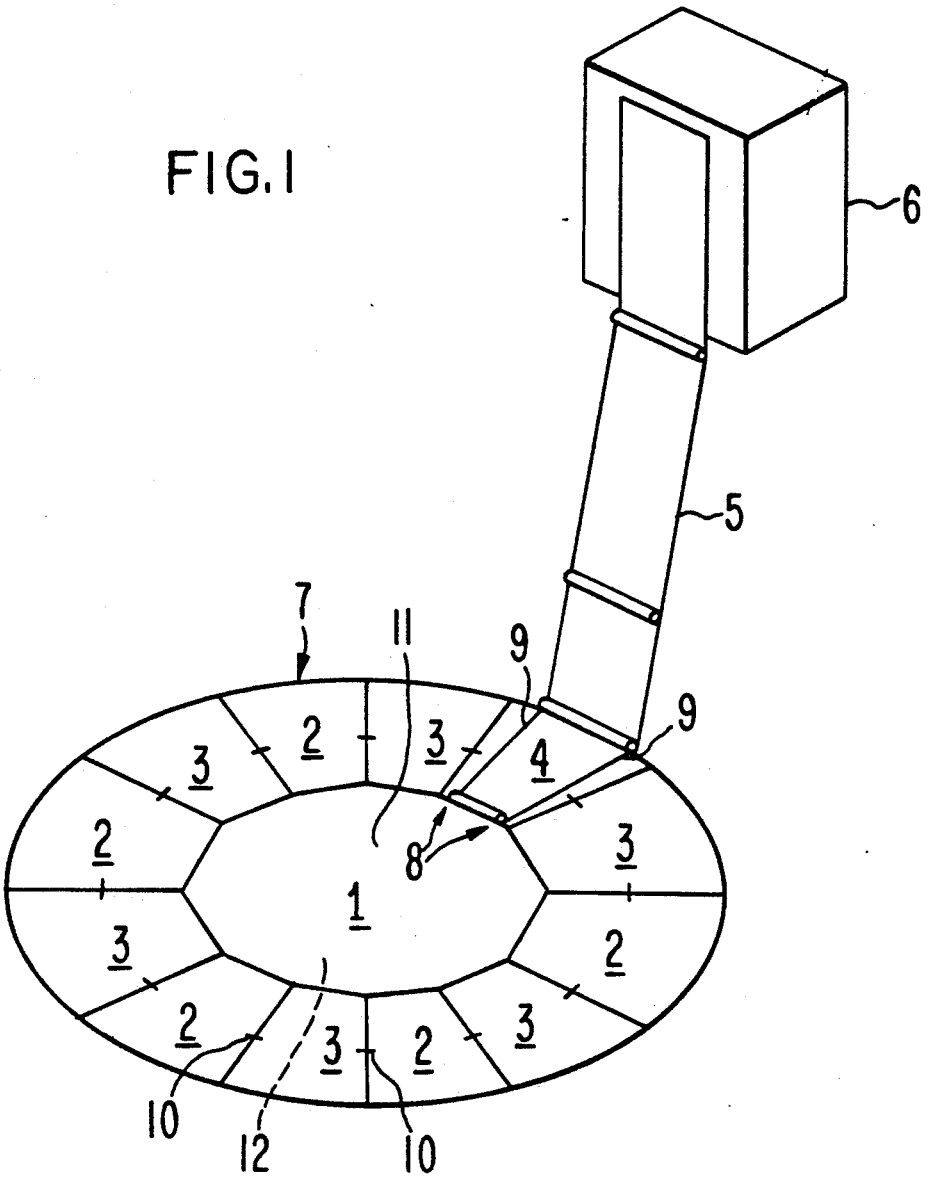
FIG. 1 is a simplified drawing of the apparatus 7 of the present invention, with the outer panels 2, 3, and 4 in the deployed position, as attached to a satellite 6.

FIG. 1 shows the paraboloidal antenna reflector 7 of the present invention in the deployed position. The antenna reflector 7 may be center fed or offset fed, and may be made from mesh or solid materials. Starting from the deployed position in FIG. 1, the antenna reflector 7 may be made extremely compact, using simple, reliable mechanisms.

The central base 1 has two sides, a first side 11, and a second side 12. In the preferred embodiment, the first side 11 is concave, and the second side 12 is flat, but other shapes of the sides 11 and 12 are possible.

The central base 1 is surrounded by two sets of outer panels 2 and 3, along with a third type of outer panel 4. In the preferred embodiment, outer panels 2 and 3 alternate around the central base 1, with panel 4 substituting in place of one of these panels 2, 3. Other embodiments could use a different order of placement of the outer panels 2, 3, 4. These panels 2, 3, and 4 are held in place using latches 10. (See FIG. 4).

Boom 5 attaches the antenna reflector 7 to a satellite 6. Boom 5 is attached to outer panel 4 by attachment means 9. To provide a collapsed position, outer panel 4 rotates to be adjacent to the first side 11 of the central base 1 by way of hinges 8. In other embodiments, panel 4 could rotate in the other direction, to be adjacent to side 12 of the central base 1.

Figure 2:
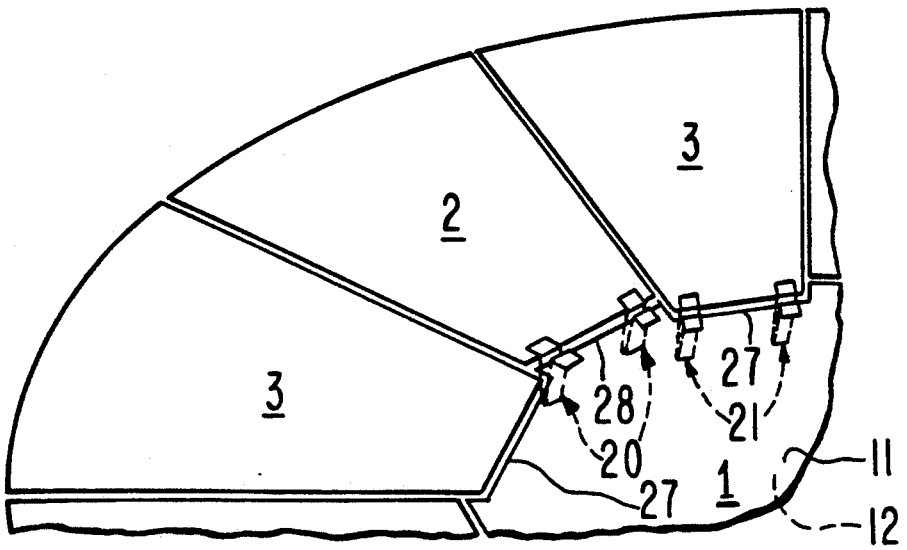
FIG. 2 shows an expanded view of two panels 2, 3, and their hinges 20, 21, as attached to the central base 1.

FIG. 2 shows hinges 20 and 21 which attach panels 2 and 3, respectively, to the central base 1. The central base has a first side 11 and a second side 12. Panel 3 collapses by rotating on hinges 21 towards the second side 12 of the central base 1. Because hinge 20 is longer than hinge 21, panel 2 may then rotate towards the second side 12 of central base 1 such that it comes to rest overlaying the collapsed panel 3. Other hinge structures may also be used in other embodiments. In the preferred embodiment, inner edge 28 of central base 1 is further from the center of central base 1 than is inner edge 27, further facilitating panel 2 to overlay panel 3 in the collapsed configuration.

Figure 3:
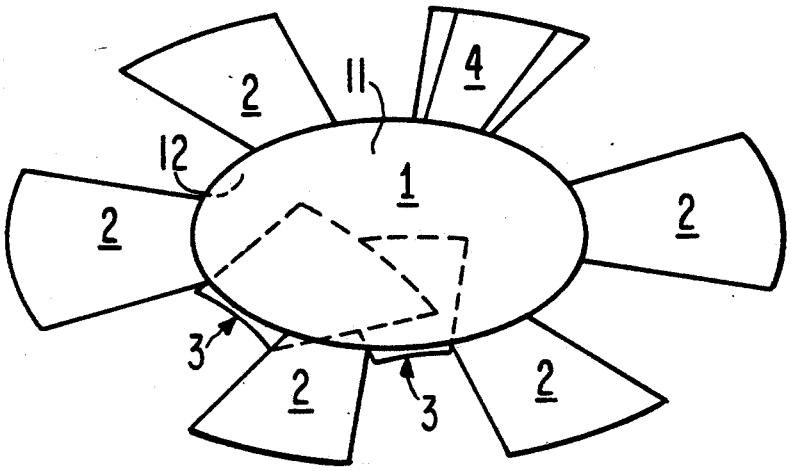
FIG. 3 shows the apparatus with a first set of panels 3 folded adjacent to the convex side 12 of the central base 1.

FIG. 3 shows the central base 1 having a first side 11 and a second side 12. Panels 3 are collapsed adjacent to side 12 of central base 1, and panels 2 have yet to be collapsed into their final compact position adjacent to collapsed panels 3.

Deployment is accomplished in the reverse order. Because the operation is simply accomplished, it lends well to automatic methods of deployment in space such as pyrotechnics. FIG. 3 shows outer panels 2 deployed, and outer panels 3 still in their collapsed positions. As shown in FIG. 2, panels 2 are deployed by rotating away from the second side 12 of central base 1 using hinges 20, and panels 3 are then rotated away from the second side 12 of central base 1 using hinges 21. FIG. 1 then shows the fully deployed antenna reflector 7, with outer panel 4 deployed by rotating away from the first side 11 of the central base 1 using hinges 8. As the later panels are rotated into position, latches 10 then engage to hold the outer panels in their deployed positions.

Figure 4:
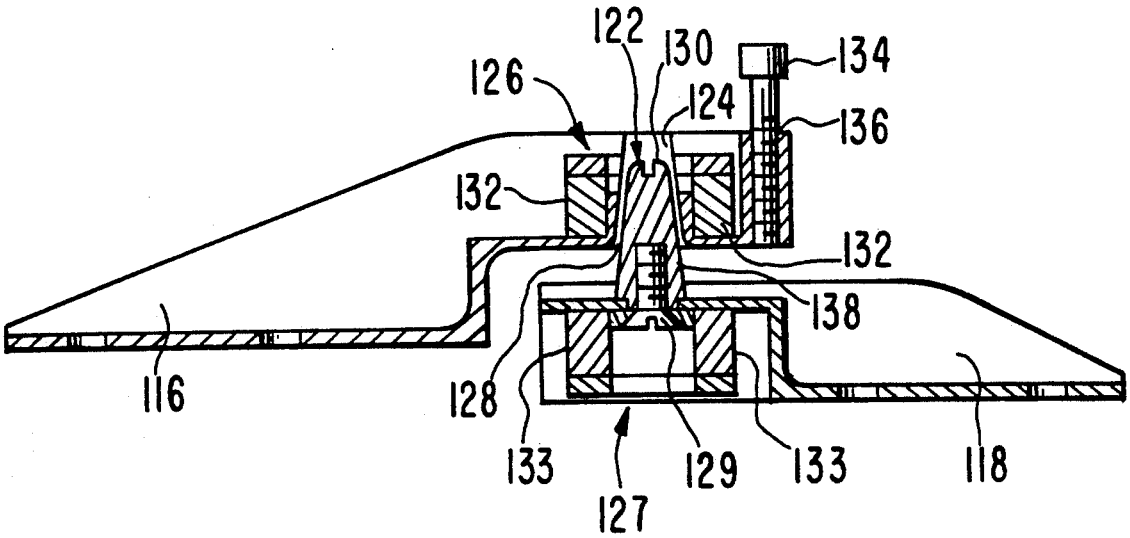
FIG. 4 shows the latch 126 and 127 used to hold panels 116, 118 in their extended positions.

In the preferred embodiment shown in FIG. 4, the latching mechanism consists of a protruding member 122 attached at the side of the descending panel 118. Protruding member 122 enters a corresponding cavity 124 in a structure 126 attached to the edge of panel 116 already in position.

The protruding member 122 may be of any variety of shapes. In order to achieve adequate lateral stability in the preferred embodiment, some portion of the side surface 138 of the protruding member 122 is inclined at an angle of greater than forty-five degrees with respect to the surface of panel 118 to which the member 122 is attached.

Generally, member 122 will either be substantially a cone in shape or substantially a frustum in shape. "Cone" as used herein means any solid determined by a connected region of a plane, called the "base," and a point off that plane, called the "apex." A cone is, then, the set of all points on all straight lines connecting any point of the base to the apex. A "circular cone" is a cone whose base is a circle. A "right circular cone" is a circular cone in which the line from the apex to the center of the base is perpendicular to the base. A "frustum" is the solid defined by any truncation of a cone by a second intersecting plane.

In the preferred embodiment, the member 122 has substantially the shape of a frustum of a right circular cone, truncated by a plane parallel to the plane of the base 129; and the sides 138 of member 122 are eighty-four degrees from the plane of the base 129. This inclination is specifically chosen to meet two requirements. The first requirement involves some inclination so that the opening 128 into the cavity 124 will be somewhat larger than the head 130 of member 122 thereby allowing some tolerance for the initial alignment of the member 122 as it enters the cavity 124. The second requirement involves providing an inclination as close to vertical as possible, which provides as great a resistance to lateral force as possible.

In the preferred embodiment, magnets 132, 133 are provided at the sides of the protruding member 122 and at the sides of the opening 128 of the cavity 124. As the descending panel 118 approaches the panel 116 already in position, magnets 132, 133 exert magnetic force to draw panels 118 and 116 together and, once together, exert further holding force. In the preferred embodiment, the magnets 132, 133 begin to exert significant force when the panels 116 and 118 are within one quarter of an inch from each other. Further, the magnets 132, 133 exert a force adequate to resist separation of the latch 10 once member 122 is fully seated.

A jacking screw 134 is inserted into a hole 136 in panel 116 and can be used to release the latching mechanism 10. When the jacking screw 134 is in a recessed position, as shown in FIG. 4, member 122 is allowed to seat fully. However, when the jacking screw 134 is turned, it moves out from its recessed position towards panel 118, pushing panel 118 from panel 116. This disengages the magnets 132 and separates the two panels 118, 116. While other release mechanisms are possible, the method described is particularly appropriate where the apparatus 7 is used as a satellite antenna reflector. There, antenna reflector 7 must be as light weight as possible, so the panels 2, 3, 4 are fairly delicate. They may be easily damaged if the magnetic force were overcome and the latches 10 disengaged by hand. Accordingly, a release mechanism which separates the panels 2, 3, 4 without applying excessive force to the panels 2, 3, 4 is necessary.

Since a satellite antenna reflector 7 once deployed is typically not disassembled in space, the jacking screw 134 may be used only to test the apparatus 7 by repeatedly assembling and disassembling it prior to launch. After testing and prior to launch, screw 134 may be removed from the apparatus 7 to save weight.

Although the invention has been described with reference to preferred embodiments, the scope of the invention should not be construed to be so limited. Many modifications may be made by those skilled in the art with the benefit of this disclosure without departing from the spirit of the invention. Therefore, the invention should not be limited by the specific examples used to illustrate it, but only by the scope of the appended claims.

What is claimed is:

1. A paraboloid shaped assembly apparatus comprising:

a central base having a first side and a second side;

a plurality of outer panels rotatably coupled about a periphery of the central base; wherein at least one of the outer panels is foldable to a collapsed position on the second side of the central base, while remaining outer panels are foldable to collapsed positions on the first side of the central base, in order to form a collapsed configuration for compact storage of the paraboloid assembly; and the outer panels are moveable to expanded positions, in order to form an expanded configuration of the paraboloid assembly; and wherein the edges of the outer panels in their expanded positions are adjacent to each other to form an assembly roughly in the shape of a paraboloid, having a focal point and a center; said apparatus further comprising;

a plurality of latching means for connecting adjacent outer panels when the outer panels are in the extended configuration.

2. The apparatus of claim 1 wherein all of the outer panels are foldable to collapsed positions in order to form said collapsed configuration for compact storage of the paraboloid assembly, and all of the outer panels are moveable to expanded positions in order to form said expanded configuration of the paraboloid assembly.

3. The apparatus of claim 1, wherein the central base and outer panels are substantially solid.

4. The apparatus of claim 1, wherein the focal point of the paraboloid is offset from the center of the paraboloid.

5. The apparatus of claim 1, further comprising a plurality of hinge means, each attached to the central base and to a different outer panel for coupling the panels to the central base and for allowing the outer panels to rotate between collapsed and extended positions.

6. The apparatus of claim 1, wherein the first side of the central base is concave, and the second side of the central base is convex.

7. The apparatus of claim 1, where the apparatus is a spacecraft antenna reflector.

8. The apparatus of claim 1, wherein each of the plurality of latching means comprises:

a protrusion on a first panel, said protrusion having a base and a surface; and a cavity on a second panel adapted to receive and hold the protrusion such that the cavity exerts a holding force on the protrusion.

9. The apparatus of claim 8, wherein the protrusion is substantially conical in shape.

10. The apparatus of claim 8, wherein the protrusion is substantially a frustum in shape.

11. The apparatus of claim 8, wherein a portion of the surface of the protrusion is inclined with respect to the base of the protrusion at an angle greater than forty-five degrees.

12. The apparatus of claim 11, wherein the protrusion is substantially conical in shape.

13. The apparatus of claim 11, wherein the protrusion is substantially a frustum in shape.

14. The apparatus of claim 13, further comprising:

magnetic means for providing an additional holding force for connecting adjacent panels to one another, and release means for releasing the latching means.

15. The apparatus of claim 14, wherein the release means comprises a jacking screw.

16. A paraboloid shaped assembly apparatus comprising:

a central base having a first side and a second side;

a plurality of outer panels rotatably coupled about a periphery of the central base; wherein at least one of the outer panels is foldable to a collapsed position on the second side of the central base, while remaining outer panels are foldable to collapsed positions on the first side of the central base, in order to form a collapsed configuration for compact storage of the paraboloid assembly; and the outer panels are moveable to expanded positions, in order to form an expanded configuration of the paraboloid assembly; and wherein the edges of the outer panels in their expanded positions are adjacent to each other to form an assembly roughly in the shape of a paraboloid, having a focal point and a center;

said apparatus further comprising a plurality of magnetic means for providing a holding force for connecting adjacent panels.

17. The apparatus of claim 1, wherein each latching means further comprises a release mechanism for releasing the latching means.

18. The apparatus of claim 17, wherein the release mechanism is a jacking screw.

* * * * *